US009391429B2

(12) United States Patent
Hartmann et al.

(10) Patent No.: US 9,391,429 B2
(45) Date of Patent: Jul. 12, 2016

(54) SPARK PLUG

(75) Inventors: Detlef Hartmann, Bamberg (DE); Dietrich Trachte, Leonberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 204 days.

(21) Appl. No.: 14/345,895

(22) PCT Filed: Aug. 3, 2012

(86) PCT No.: PCT/EP2012/065279

§ 371 (c)(1),
(2), (4) Date: Jun. 17, 2014

(87) PCT Pub. No.: WO2013/045145

PCT Pub. Date: Apr. 4, 2013

(65) Prior Publication Data

US 2014/0320010 A1 Oct. 30, 2014

(30) Foreign Application Priority Data

Sep. 28, 2011 (DE) ..... 10 2011 083 640

(51) Int. Cl.
*H01T 13/20* (2006.01)
*H01T 13/39* (2006.01)
*H01T 15/00* (2006.01)

(52) U.S. Cl.
CPC ..... *H01T 13/20* (2013.01); *H01T 13/39* (2013.01); *H01T 15/00* (2013.01)

(58) Field of Classification Search
CPC ..... H01T 13/20; H01T 13/39; H01T 13/32
USPC ..... 313/143, 141
See application file for complete search history.

(56) References Cited

U.S. PATENT DOCUMENTS 7,145,287 B2 * 12/2006 Kato ..... H01T 13/39 313/118
2002/0038992 A1 4/2002 Morita et al.

FOREIGN PATENT DOCUMENTS

| | | |
|---|---|---|
| DE | 197 37 614 | 3/1998 |
| EP | 1353423 | 10/2003 |
| JP | H 05-335066 | 12/1993 |
| JP | 2000243536 A | 9/2000 |
| JP | 2006-120649 | 5/2006 |
| JP | 2011119143 A | 6/2011 |

OTHER PUBLICATIONS

International Search Report for PCT/EP2012/065279, dated Nov. 16, 2012.

* cited by examiner

*Primary Examiner* — Vip Patel
(74) *Attorney, Agent, or Firm* — Norton Rose Fulbright US LLP

(57) ABSTRACT

A spark plug for an internal combustion engine, including: a center electrode having a first noble metal pin of a first diameter mounted thereon, and a ground electrode having a second noble metal pin of a second diameter mounted thereon, the noble metal pins of the center electrode and of the ground electrode being mutually opposed at the end faces thereof; and the first diameter of the first noble metal pin of the center electrode being larger than the second diameter of the second noble metal pin of the ground electrode.

7 Claims, 1 Drawing Sheet

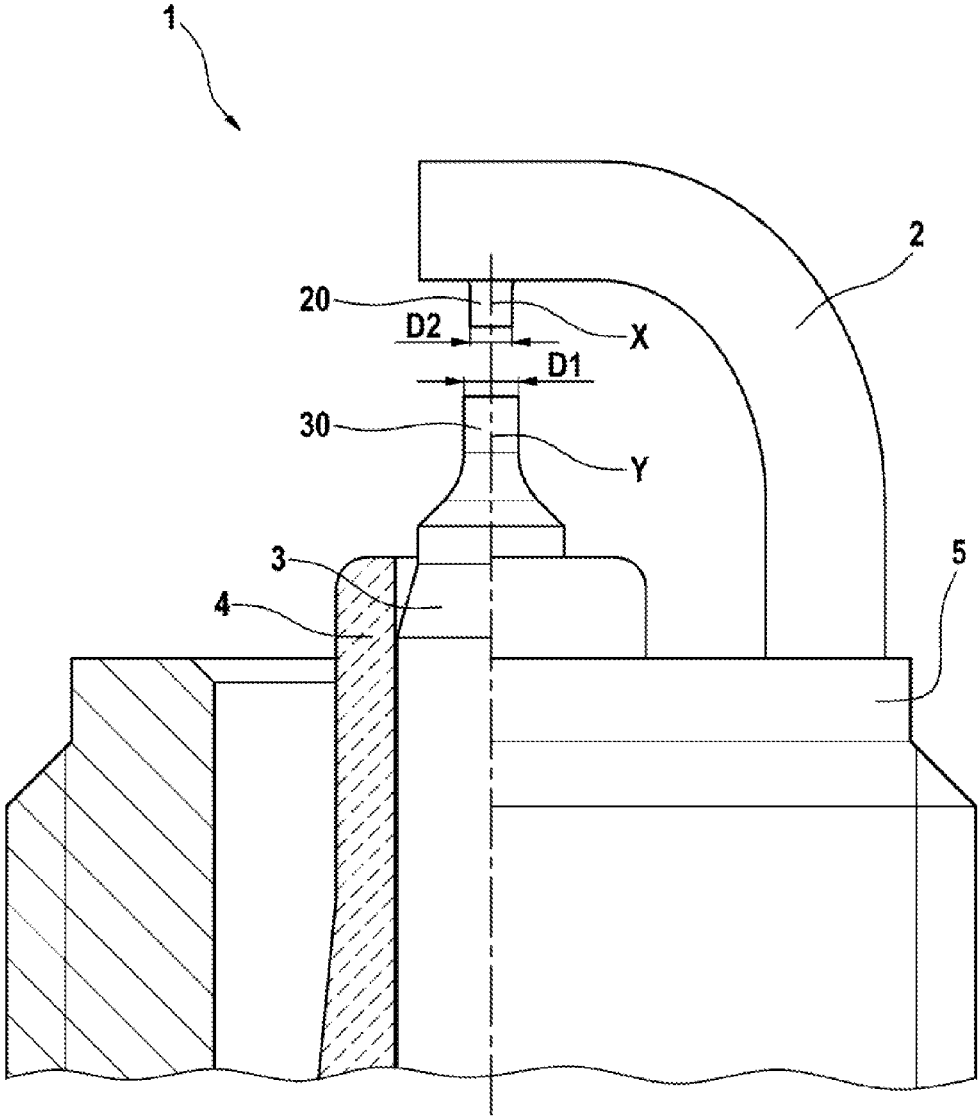
1
2
20
D2
X
D1
30
Y
3
4
5

SPARK PLUG

BACKGROUND OF THE INVENTION

1. Field of the Invention

The present invention relates to an improved spark plug in what is generally referred to as a pin-to-pin configuration having greatly improved wear characteristics.

2. Description of the Related Art

Spark plugs of various designs are generally known from the related art. In the case of known spark plugs having what is generally referred to as a top electrode, where the ground electrode is disposed over the center electrode in the axial direction of the spark plug, pins that usually contain noble metal are used to improve the service life of the spark plug. These noble metal pins exhibit excellent resistance to corrosion and erosion. In addition, the mutually opposing configuration of the noble metal pins on the center electrode and on the ground electrode ensures a very effective ignition of the fuel mixture. The noble metal pins can be joined to the particular base electrodes by welding, for example. The noble metal pins are normally cylindrical and configured in a way that allows a pin of a larger of the two diameters to be mounted on the ground electrode, and a pin of the smaller of the pin diameters to be mounted on the center electrode. This measure provides a reliable overlap between the noble metal pin of the center electrode and that of the ground electrode, making it possible for even manufacturing-induced, as well as for tolerance-induced tolerances to be compensated for. Alternatively, the diameters of the noble metal pins are of the same size. In addition, single-spark ignition coils are typically used in modern internal combustion engines, where the center electrode is provided as a cathode. It turns out in this connection that the center electrode is subject to greater wear than is the ground electrode, the wear ratio being from 1/3 to 2/3. However, since the noble metal pins are very expensive components of the spark plugs, it would be desirable to have electrodes that exhibit a most uniform possible wear over the total service life of the spark plug.

BRIEF SUMMARY OF THE INVENTION

In contrast, the spark plug according to the present invention has the advantage that noble metal pins on the center electrode and the ground electrode are subject to the same wear over the entire service life of the spark plug. This leads to an optimal utilization of the expensive noble metal materials in the noble metal pins and, in particular, to a prolonged service life of the spark plugs. This is achieved in accordance with the present invention in that the center electrode and the ground electrode are mutually opposed at the end faces thereof (generally referred to as a pin-to-pin configuration). The noble metal pin on the center electrode is larger in diameter than the noble metal pin on the ground electrode. In addition, an optimal utilization of the noble metal is achieved in accordance with the present invention. Selecting a larger diameter for the center electrode also makes it possible to compensate for tolerances related to an electrode overlap.

The center electrode is preferably between 1 to 1.5 times greater in diameter than the ground electrode. By observing these relative proportions, it is possible, in particular, to minimize the wear between the two noble metal pins of the electrodes.

It is also preferred that the diameters of the center electrode and of the ground electrode at the front end regions of the noble metal pins be within a range of from 0.4 mm to 1.5 mm, preferably between 0.4 mm and 0.9 mm.

It is also preferred that a ratio V of a diameter of the center electrode to a diameter of the ground electrode be between $1.2 \leq V \leq 1.4$, preferably between $1.25 \leq V \leq 1.35$.

The present invention also relates to an ignition device, including a spark plug according to the present invention, as well as a single-spark ignition coil, the center electrode being configured as a cathode.

BRIEF DESCRIPTION OF THE DRAWING

FIG. 1 is a schematic, part-sectional view of a spark plug in accordance with a preferred exemplary embodiment of the present invention.

DETAILED DESCRIPTION OF THE INVENTION

A spark plug 1 in accordance with a preferred exemplary embodiment of the present invention is described in detail in the following with reference to FIG. 1.

Spark plug 1 includes a ground electrode 2 in the form of a top electrode, and a center electrode 3. A noble metal pin 20 is disposed on ground electrode 2. A noble metal pin 30 is likewise disposed on center electrode 3. The two noble metal pins 20, 30 are oriented with the end faces thereof facing one another (what is generally referred to as a pin-to-pin configuration). In addition, spark plug 1 includes an insulator 4 and a spark plug housing 5.

As is readily apparent from FIG. 1, noble metal pin 20 of the ground electrode is positioned relative to noble metal pin 30 of center electrode 3 in a way that allows central axes X and Y of the noble metal pins to coincide. In addition, diameter D1 of noble metal pin 30 of center electrode 3 is larger than a diameter D2 of noble metal pin 20 of ground electrode 2. It is thus possible to reliably ensure an overlapping, even taking into account manufacturing- and/or assembly-induced tolerances. A reliable and uniform ignitability of a fuel mixture is hereby achieved. At the same time, a more uniform wear of both noble metal pins 20, 30 of the electrodes is achieved.

In this exemplary embodiment, a diameter D1 of center electrode 3 is 0.8 mm, and a diameter D2 of noble metal pin 20 of ground electrode 3 is 0.6 mm. Thus, the diameter of center electrode 3 is approximately 1.33 times greater than diameter D2 of ground electrode 2. Alternatively, diameter D1 of center electrode is 1.0 mm, and diameter D2 of ground electrode is 0.8 mm, so that the diameter of center electrode 3 is 1.25 times diameter D2 of ground electrode 2.

Thus, an improved service life of the spark plug may be surprisingly achieved by the measure according to the present invention of providing a noble metal pin 30 on center electrode 3 with a larger diameter than on ground electrode 2 in the case of a pin-to-pin configuration. In particular, a more uniform wear of both noble metal pins 20, 30 of the electrodes may be made possible. Thus, an optimal design of the spark plug with respect to the expensive noble metal may be rendered possible, thereby making it possible to significantly reduce the manufacturing costs for the spark plugs according to the present invention.

What is claimed is:

1. A spark plug for an internal combustion engine, comprising:

a center electrode having a first noble metal pin of a first diameter mounted on the center electrode; and a ground electrode having a second noble metal pin of a second diameter mounted on the ground electrode;

wherein:

an end face of the noble metal pin of the center electrode oppose an end face of the ground electrode mutually oppose;

the first diameter of the first noble metal pin of the center electrode is larger than the second diameter of the second noble metal pin of the ground electrode by a ratio V; and $V \leq 1.5$.

2. The spark plug as recited in claim 1, wherein at least one of the first diameter and the second diameter is between 0.4 mm and 1.5 mm.

3. The spark plug as recited in claim 1, wherein $1.2 \leq V \leq 1.4$.

4. The spark plug as recited in claim 1, wherein $1.25 \leq V \leq 1.35$.

5. The spark plug as recited in claim 1, wherein V is 1.33.

6. The spark plug as recited in claim 1, wherein V is 1.25.

7. An ignition device, comprising:

a single-spark ignition coil; and a spark plug including:

a center electrode having a first noble metal pin of a first diameter mounted on the center electrode, wherein the center electrode is configured as a cathode; and a ground electrode having a second noble metal pin of a second diameter mounted on the ground electrode;

wherein:

an end face of the noble metal pin of the center electrode oppose an end face of the ground electrode mutually oppose;

the first diameter of the first noble metal pin of the center electrode is larger than the second diameter of the second noble metal pin of the ground electrode by a ratio V; and $V \leq 1.5$.

* * * * *